US008385506B2

(12) United States Patent
Lemaitre et al.

(10) Patent No.: US 8,385,506 B2
(45) Date of Patent: Feb. 26, 2013

(54) X-RAY CATHODE AND METHOD OF MANUFACTURE THEREOF

(75) Inventors: Sergio Lemaitre, Whitefish Bay, WI (US); Julin Wan, Rexford, NY (US); Sergiy Zalyubovsky, Niskayuna, NY (US); Andrey Ivanovich Meshkov, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 79 days.

(21) Appl. No.: 12/698,851

(22) Filed: Feb. 2, 2010

(65) Prior Publication Data

US 2011/0188637 A1 Aug. 4, 2011

(51) Int. Cl.
*H01J 35/06* (2006.01)

(52) U.S. Cl. ..... 378/136

(58) Field of Classification Search ..... 378/134, 378/136–138

See application file for complete search history.

(56) References Cited

U.S. PATENT DOCUMENTS

| | | | | |
|---|---|---|---|---|
| 3,558,964 | A | 1/1971 | White | |
| 3,914,639 | A * | 10/1975 | Barraco et al. | 313/271 |
| 4,607,380 | A * | 8/1986 | Oliver | 378/138 |
| 4,631,742 | A * | 12/1986 | Oliver | 378/113 |
| 4,675,570 | A | 6/1987 | Green | |
| 4,685,118 | A * | 8/1987 | Furbee et al. | 378/114 |
| 4,752,713 | A | 6/1988 | Buxbaum | |
| 4,821,305 | A * | 4/1989 | Anderson | 378/136 |
| 4,894,257 | A | 1/1990 | Smith et al. | |
| 5,703,924 | A | 12/1997 | Hell et al. | |
| 6,051,165 | A | 4/2000 | Billings | |
| 6,642,657 | B2 | 11/2003 | Mako et al. | |
| 6,759,799 | B2 | 7/2004 | Ricaud | |
| 6,762,540 | B2 | 7/2004 | Schaefer et al. | |
| 6,785,359 | B2 * | 8/2004 | Lemaitre | 378/136 |
| 6,968,039 | B2 | 11/2005 | Lemaitre et al. | |
| 7,085,351 | B2 * | 8/2006 | Lu et al. | 378/122 |
| 7,206,379 | B2 | 4/2007 | Lemaitre | |
| 7,280,637 | B1 | 10/2007 | Chen et al. | |
| 7,352,840 | B1 | 4/2008 | Nagarkar et al. | |
| 7,409,043 | B2 | 8/2008 | Dunham et al. | |
| 7,450,690 | B2 | 11/2008 | Block et al. | |
| 7,539,286 | B1 * | 5/2009 | Bandy et al. | 378/136 |
| 7,558,374 | B2 | 7/2009 | Lemaitre | |
| 7,576,481 | B2 | 8/2009 | Lemaitre | |
| 7,627,087 | B2 | 12/2009 | Zou et al. | |
| 7,693,265 | B2 * | 4/2010 | Hauttmann et al. | 378/136 |
| 7,795,792 | B2 * | 9/2010 | Arnold et al. | 313/271 |
| 7,903,788 | B2 * | 3/2011 | Moore et al. | 378/136 |
| 2001/0052743 | A1 * | 12/2001 | Hell et al. | 313/341 |
| 2003/0025429 | A1 * | 2/2003 | Hell et al. | 313/310 |

(Continued)

FOREIGN PATENT DOCUMENTS

| | | |
|---|---|---|
| JP | 61173436 | 8/1986 |
| WO | 2008129006 | 10/2008 |

(Continued)

*Primary Examiner* — Thomas R Artman
(74) *Attorney, Agent, or Firm* — Fletcher Yoder, P.C.

(57) ABSTRACT

The disclosed embodiments include embodiments such as an X-ray tube cathode filament system. The X-ray tube cathode filament system includes a substrate and a coating disposed on the substrate. In this cathode filament system, an electron beam is emitted from the coating but not from the substrate. The electron beam is produced through the use of the thermionic effect.

17 Claims, 5 Drawing Sheets

U.S. PATENT DOCUMENTS

| | | | | |
|---|---|---|---|---|
| 2005/0179024 | A1 | 8/2005 | Shibata et al. | |
| 2007/0083577 | A1 | 4/2007 | Capaldo et al. | |
| 2007/0232183 | A1 | 10/2007 | Lemaitre | |
| 2008/0043916 | A1 | 2/2008 | Lemaitre | |
| 2008/0095317 | A1 | 4/2008 | Lemaitre | |
| 2009/0260233 | A1 | 10/2009 | Lemaitre | |
| 2009/0323898 | A1* | 12/2009 | Moore | 378/136 |
| 2010/0150315 | A1* | 6/2010 | Filmer et al. | 378/136 |
| 2010/0195797 | A1* | 8/2010 | Hauttmann | 378/136 |
| 2010/0284519 | A1 | 11/2010 | Moore et al. | |
| 2011/0026681 | A1* | 2/2011 | Zou et al. | 378/136 |
| 2011/0051898 | A1 | 3/2011 | Moore et al. | |

FOREIGN PATENT DOCUMENTS

| | | | |
|---|---|---|---|
| WO | 2010002610 | A2 | 7/2010 |

* cited by examiner

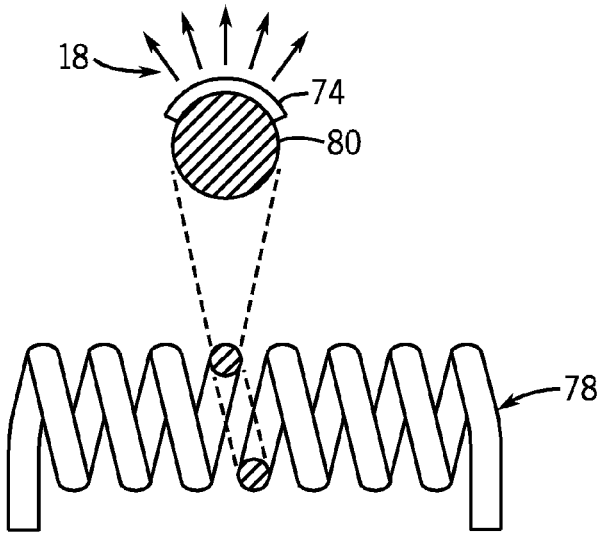
FIG. 7
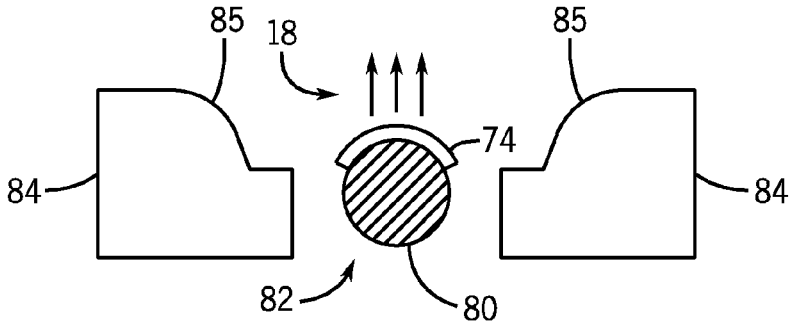
FIG. 8
FIG. 9
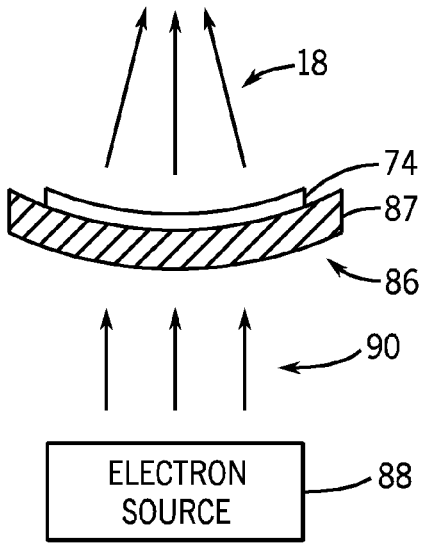

X-RAY CATHODE AND METHOD OF MANUFACTURE THEREOF

BACKGROUND OF THE INVENTION

The subject matter disclosed herein relates to X-ray tubes, and in particular, to X-ray cathode systems and methods of manufacturing X-ray cathodes.

X-ray tubes typically include an electron source, such as a cathode, that releases electrons at high acceleration. Some of the released electrons may impact a target anode. The collision of the electrons with the target anode produces X-rays, which may be used in a variety of medical devices such as computed tomography (CT) imaging systems, X-ray scanners, and so forth. In thermionic cathode systems, a filament is included that may be induced to release electrons through the thermionic effect, i.e. in response to being heated. However, the distance between the cathode and the anode must be kept short so as to allow for proper electron bombardment. Further, thermionic X-ray cathodes typically emit electrons throughout the entirety of the surface of the filament. Accordingly, it is very difficult to focus all electrons into a small focal spot.

BRIEF DESCRIPTION OF THE INVENTION

In one embodiment, an X-ray cathode tube filament includes a substrate and a coating disposed on the substrate. A thermionic effect is used to emit an electron beam from the coating but not from the substrate.

In a second embodiment, an X-ray tube system is provided that includes a first cathode filament and a target anode. The first cathode filament includes a substrate and a coating disposed on the substrate. The target anode is positioned a cathode-target distance away from and facing the first cathode filament. A first stream of electrons is emitted from the first cathode filament coating through the thermionic effect and accelerated into a first focal spot on the target anode in order to produce X-rays.

In a third embodiment, a method of manufacturing an X-ray cathode system is provided. The method of manufacturing includes disposing a coating onto a substrate of a filament and placing the coated filament in a cathode assembly. The coating has a lower work function than the filament substrate.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 7 depicts an embodiment of a partially coated wound filament, in accordance with an embodiment of the present technique;

FIG. 8 depicts an embodiment of a partially coated straight wire filament, in accordance with an embodiment of the present technique; and FIG. 9 depicts a partially coated curved filament that may be used for indirect electron emissions, in accordance with an embodiment of the present technique.

DETAILED DESCRIPTION OF THE INVENTION

In certain X-ray cathode assemblies, one or more thermionic filaments may be employed to emit a stream of electrodes. A thermionic filament may be induced to release electrons from the filament's surface through the application of heat energy. Indeed, the hotter the filament material, the greater the number of electron that may be emitted. The filament material is typically chosen for its ability to generate electrons through the thermionic effect and for its ability withstand high heat, in some cases, upwards of approximately 2500° C. or higher. Traditionally, the filament material has been chosen to be tungsten or a tungsten derivative such as doped tungsten (i.e., tungsten with added impurities). Tungsten has a high melting point and a relatively low work function (i.e., a measure of the minimum energy required to induce an electron to leave a material). However, a traditional tungsten filament typically emits less electrons than coated filament embodiments as disclosed and discussed herein, at the same temperature. Accordingly, X-ray tubes employing the disclosed coated filaments embodiments may be capable of generating a higher X-ray output when compared to X-ray tubes employing traditional uncoated filaments at the same temperature.

Figure 1:
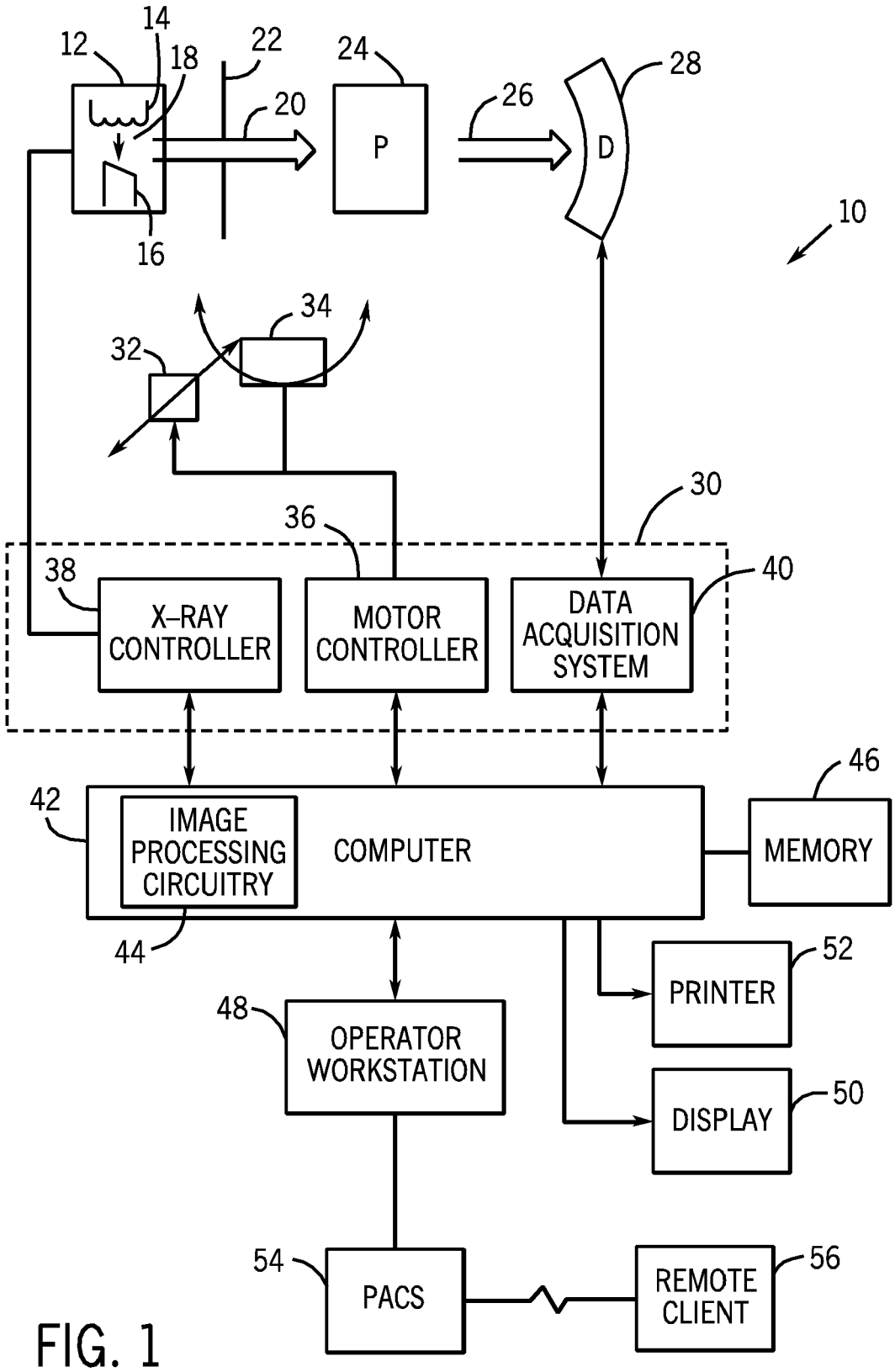
FIG. 1 is a diagrammatical illustration of an exemplary CT imaging system, in accordance with an embodiment of the present technique.

With the foregoing in mind, it may be beneficial to discuss embodiments of imaging systems that may incorporate the coated filaments as described herein before discussing these disclosures in detail. With this in mind, and turning now to the figures, FIG. 1 is a diagram that illustrates an imaging system 10 for acquiring and processing image data. In the illustrated embodiment, system 10 is a computed tomography (CT) system designed to acquire X-ray projection data, to reconstruct the projection data into a tomographic image, and to process the image data for display and analysis. Though the imaging system 10 is discussed in the context of medical imaging, the techniques and configurations discussed herein are applicable in other non-invasive imaging contexts, such as baggage or package screening or industrial nondestructive evaluation of manufactured parts. In the embodiment illustrated in FIG. 1, the CT imaging system 10 includes an X-ray source 12. As discussed in detail herein, the source 12 may include one or more conventional X-ray sources, such as an X-ray tube. For example, the source 12 may include an X-ray tube with a cathode assembly 14 and an anode 16 as described in more detail with respect to FIG. 2 below. The cathode assembly 14 may accelerate a stream of electrons 18 (i.e., the electron beam), some of which may impact the target anode 16. The electron beam 18 impacting on the anode 16 causes the emission of an X-ray beam 20.

The source 12 may be positioned proximate to a collimator 22. The collimator 22 may consist of one or more collimating regions, such as lead or tungsten shutters, for each emission point of the source 12. The collimator 22 typically defines the size and shape of the one or more X-ray beams 20 that pass into a region in which a subject 24 or object is positioned. Each X-ray beam 20 may be generally fan-shaped or cone-shaped, depending on the configuration of the detector array and/or the desired method of data acquisition. An attenuated portion 26 of each X-ray beam 20 passes through the subject or object, and impacts a detector array, represented generally at reference numeral 28.

The detector 28 is generally formed by a plurality of detector elements that detect the X-ray beams 20 after they pass through or around a subject or object placed in the field of view of the imaging system 10. Each detector element produces an electrical signal that represents the intensity of the X-ray beam incident at the position of the detector element when the beam strikes the detector 28. Electrical signals are acquired and processed to generate one or more scan datasets.

A system controller 30 commands operation of the imaging system 10 to execute examination and/or calibration protocols and to process the acquired data. The source 12 is typically controlled by a system controller 30. Generally, the system controller 30 furnishes power, focal spot location, control signals and so forth, for the X-ray examination sequences. The detector 28 is coupled to the system controller 30, which commands acquisition of the signals generated by the detector 28. The system controller 30 may also execute various signal processing and filtration functions, such as initial adjustment of dynamic ranges, interleaving of digital image data, and so forth. In the present context, system controller 30 may also include signal processing circuitry and associated memory circuitry. As discussed in greater detail below, the associated memory circuitry may store programs, routines, and/or encoded algorithms executed by the system controller 30, configuration parameters, image data, and so forth. In one embodiment, the system controller 30 may be implemented as all or part of a processor-based system such as a general purpose or application-specific computer system.

In the illustrated embodiment of FIG. 1, the system controller 30 may control the movement of a linear positioning subsystem 32 and a rotational subsystem 34 via a motor controller 36. In an embodiment where the imaging system 10 includes rotation of the source 12 and/or the detector 28, the rotational subsystem 34 may rotate the source 12, the collimator 22, and/or the detector 28 about the subject 24. It should be noted that the rotational subsystem 34 might include a gantry comprising both stationary components (stator) and rotating components (rotor).

The linear positioning subsystem 32 may linearly displace a table or support on which the subject or object being imaged is positioned. Thus, the table or support may be linearly moved within the gantry or within an imaging volume (e.g., the volume located between the source 12 and the detector 28) and enable the acquisition of data from particular areas of the subject or object and, thus the generation of images associated with those particular areas. Additionally, the linear positioning subsystem 32 may displace one or more components of the collimator 22, so as to adjust the shape and/or direction of the X-ray beam 20. Further, in embodiments in which the source 12 and the detector 28 are configured to provide extended or sufficient coverage along the z-axis (i.e., the axis generally associated with the length of the patient table or support and/or with the lengthwise direction of the imaging bore) and/or in which the linear motion of the subject or object is not required, the linear positioning subsystem 32 may be absent.

As will be appreciated by those skilled in the art, the source 12 may be controlled by an X-ray controller 38 disposed within the system controller 30. The X-ray controller 38 may be configured to provide power and timing signals to the source 12. In addition, in some embodiments the X-ray controller 30 may be configured to selectively activate the source 12 such that tubes or emitters at different locations within the system 10 may be operated in synchrony with one another or independent of one another.

Further, the system controller 30 may comprise a data acquisition system (DAS) 40. In one embodiment, the detector 28 is coupled to the system controller 30, and more particularly to the data acquisition system 40. The data acquisition system 40 receives data collected by readout electronics of the detector 28. The data acquisition system 40 typically receives sampled analog signals from the detector 28 and converts the data to digital signals for subsequent processing by a processor-based system, such as a computer 42. Alternatively, in other embodiments, the detector 28 may convert the sampled analog signals to digital signals prior to transmission to the data acquisition system 40.

In the depicted embodiment, a computer 42 is coupled to the system controller 30. The data collected by the data acquisition system 40 may be transmitted to the computer 42 for subsequent processing. For example, the data collected from the detector 28 may undergo pre-processing and calibration at the data acquisition system 40 and/or the computer 42 to produce representations of the line integrals of the attenuation coefficients of the subject or object undergoing imaging. In one embodiment, the computer 42 contains data processing circuitry 44 for filtering and processing the data collected from the detector 28.

The computer 42 may include or communicate with a memory 46 that can store data processed by the computer 42, data to be processed by the computer 42, or routines and/or algorithms to be executed by the computer 42. It should be understood that any type of computer accessible memory device capable of storing the desired amount or type of data and/or code may be utilized by the imaging system 10. Moreover, the memory 46 may comprise one or more memory devices, such as magnetic, solid state, or optical devices, of similar or different types, which may be local and/or remote to the system 10.

The computer 42 may also be adapted to control features enabled by the system controller 30 (i.e., scanning operations and data acquisition). Furthermore, the computer 42 may be configured to receive commands and scanning parameters from an operator via an operator workstation 48 which may be equipped with a keyboard and/or other input devices. An operator may, thereby, control the system 10 via the operator workstation 48. Thus, the operator may observe from the computer 42 a reconstructed image and/or other data relevant to the system 10. Likewise, the operator may initiate imaging or calibration routines, select and apply image filters, and so forth, via the operator workstation 48.

As illustrated, the system 10 may also include a display 50 coupled to the operator workstation 48. Additionally, the system 10 may include a printer 52 coupled to the operator workstation 48 and configured to print such voltage measurement results. The display 50 and the printer 52 may also be connected to the computer 42 directly or via the operator workstation 48. Further, the operator workstation 48 may include or be coupled to a picture archiving and communications system (PACS) 54. It should be noted that PACS 54 might be coupled to a remote system 56, radiology department information system (RIS), hospital information system (HIS) or to an internal or external network, so that others at different locations can gain access to the image data.

Figure 2:
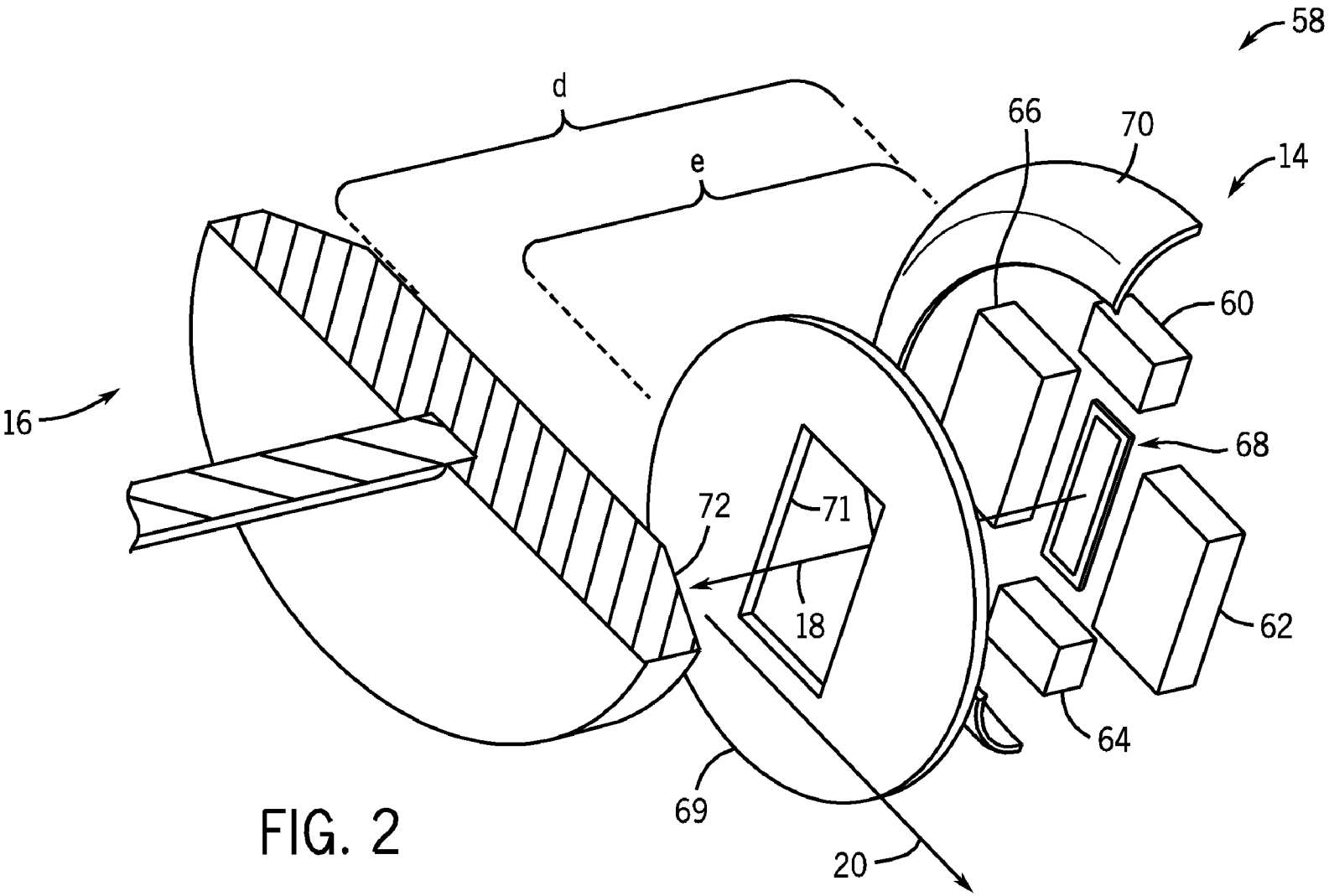
FIG. 2 illustrates and embodiment of an X-ray tube assembly, including an anode and a cathode assembly, in accordance with an embodiment of the present technique.

With the foregoing general system description in mind and turning now to FIG. 2, the figure depicts an embodiment of an X-ray tube assembly 58, including embodiments of the cathode assembly 14 and the anode 16 shown in FIG. 1. In the illustrated embodiment, the cathode assembly 14 and the target anode 16 are placed at a cathode-target distance d away from each other, and are oriented towards each other. The cathode assembly 14 may include a set of bias electrodes (i.e., deflection electrodes) 60, 62, 64, 66, a filament 68, an extraction electrode 69 and a shield 70 described in more detail with respect to FIG. 3 below. The anode 16 may be manufactured of any suitable metal or composite, including tungsten, molybdenum, or copper. The anode's surface material is typically selected to have a relatively high refactory value so as to withstand the heat generated by electrons impacting the anode 16. In certain embodiments, the anode 16 may be a rotating disk, as illustrated. Accordingly, the anode 16 may be rotated at a high speed (e.g., 1,000 to 10,000 revolutions per minute) so as to spread the incident thermal energy and achieve a higher temperature tolerance. The rotation of the anode 16 results in the temperature of the focal spot 72 (i.e., the location on the anode impinged upon by the electrons) being kept at a lower value than when the anode 16 is not rotated, thus allowing for the use of high flux X-rays embodiments.

The cathode assembly 14, i.e., electron source, is positioned a cathode-target distance d away from the anode 16 so that the electron beam 18 generated by the cathode assembly 14 is focused on a focal spot 72 on the anode 16. The space between the cathode assembly 14 and the anode 16 is typically evacuated in order to minimize electron collisions with other atoms and to maximize an electric potential. A strong electric potential, in some cases upwards of 20 kV, is typically created between the cathode 14 and the anode 16, causing electrons emitted by the cathode 14 through the thermionic effect to become strongly attracted to the anode 16. The resulting electron beam 18 is directed toward the anode 16. The resulting electron bombardment of the focal spot 72 will generate an X-ray beam 20 through the Bremsstrahlung effect, i.e., braking radiation.

The distance d is a factor in determining focal spot 72 characteristics such as length and width, and accordingly, the imaging capabilities of the generated X-ray beam 20. If the distance d is too great, an insufficient number of electrons will impinge the anode 16 and/or the electron beam 18 may spread out too much to generate a properly sized X-ray beam 20. The resulting X-ray images may contain blurs or other imaging artifacts. Traditionally, the distance d has been set to less than approximately 50 mm so as to define a small focal spot (e.g., approximately less than 0.25 $mm^2$ or smaller), capable of generating a suitable X-ray beam 20. The embodiments disclosed herein and discussed in more detail with respect to the figures below allow for the distance d to be set at approximately a distance d of 50 mm or longer. Indeed, the disclosed embodiments allow for very small focal spot sizes at longer cathode-target distances, thus allow for the accommodation of other devices, such as electron collectors or beam handling magnets, inside of the X-ray tube assembly 58.

In certain embodiments, the extraction electrode 69 is included and is disposed between the cathode assembly 14 and the anode 16. In other embodiments, the extraction electrode 69 is not included. When included, the extraction electrode may be kept at the anode 16 potential, in some cases, upwards of 20 kV. The extraction electrode 69 includes an opening 71. The opening 71 allows for the passage of electrons through the extraction electrode 69. In the depicted embodiment, the extraction electrode is positioned at a cathode-electrode distance e away from the cathode assembly 14. The cathode-electrode distance e is also a factor in determining focal spot 72 characteristics such as length and width, and accordingly, the imaging capabilities of the generated X-ray beam 20. The electrons are accelerated over the distance e and drift without acceleration over the distance d-e. If the distance e is too great, an insufficient number of electrons will impinge the anode 16 and/or the electron beam 18 may spread out too much to generate a properly sized X-ray beam 20. The resulting X-ray images may contain blurs or other imaging artifacts. Traditionally, the distance e has been set to less than approximately 50 mm so as to define a small focal spot (e.g., approximately less than 0.25 $mm^2$ or smaller), capable of generating a suitable X-ray beam 20. The embodiments disclosed herein and discussed in more detail with respect to the figures below allow for the distance e to be set at a distance e of approximately 15 mm to upwards of 50 mm.

Figure 3:
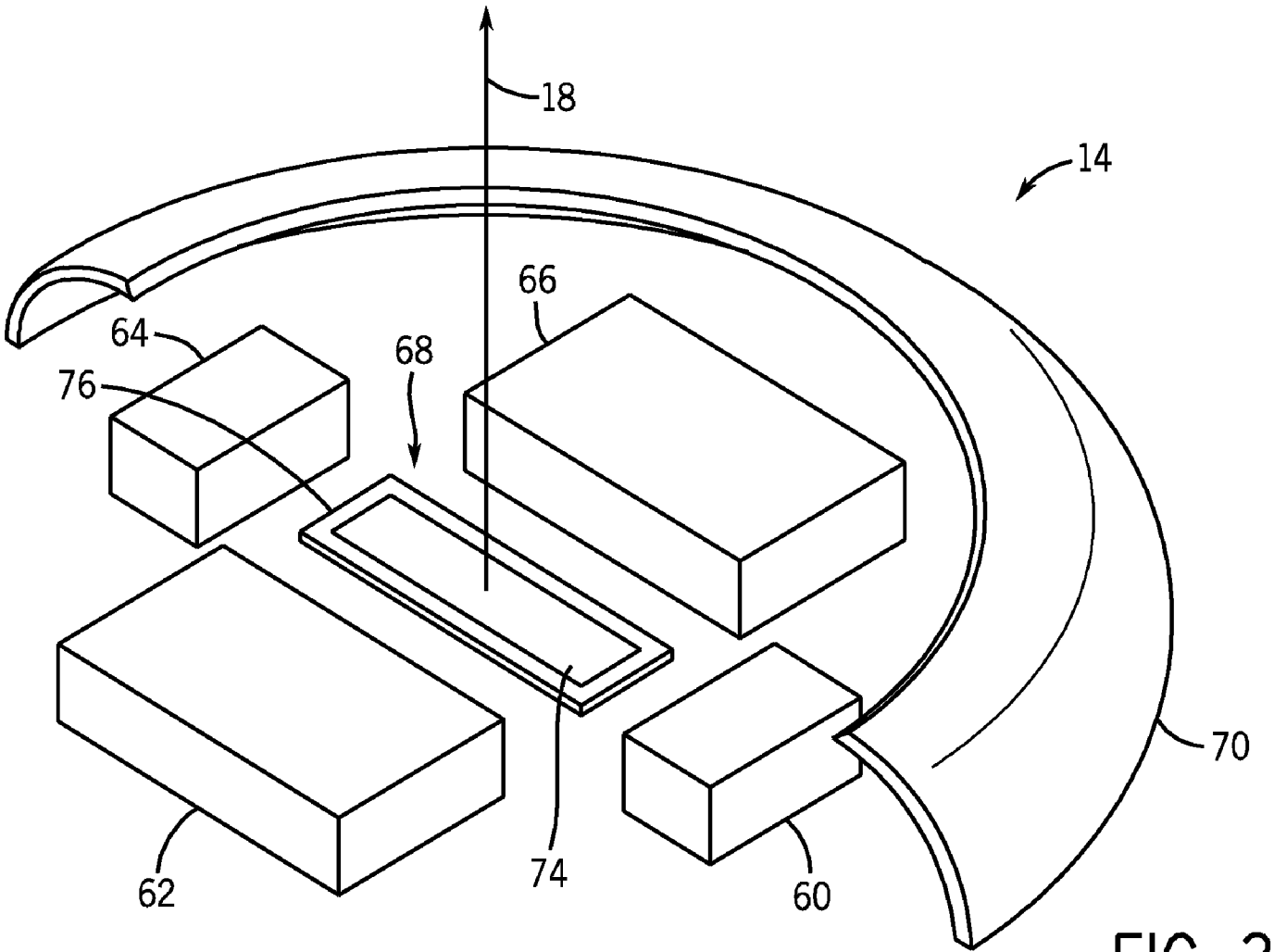
FIG. 3 illustrates an embodiment of a cathode assembly including a partially coated thermionic filament, in accordance with an embodiment of the present technique.

Turning to FIG. 3, the figure illustrates an embodiment of an X-ray cathode assembly 14 where the filament 68 is a coated, flat thermionic filament. In the illustrated embodiment, the filament 68 includes a coating 74 disposed on a substrate 76. In certain embodiments, the coating 74 may be manufactured out of materials such as hafnium carbide, tantalum carbide, hafnium diboride, zirconium carbide, hafnium nitride, tantalum nitride, zirconium nitride, tungsten diboride and their derivatives, and deposited on the substrate 76 as described in more detail below with respect to FIGS. 4-6. The substrate 76 may be manufactured in the form of a slab or a rectangle of a material such as tungsten or tantalum. It is to be understood that the substrate 76 may have other shapes, such as a wire, a wound wire, a curved disk, a flat disk, and so forth.

A coating 74 may be selected that has a lower work function than that of the substrate 76. That is, the coating 74 may require less thermal energy to release electrons than the thermal energy required of the substrate 76. Indeed, in filament embodiments where the coating has a work function of approximately 3.5 electron volts (eV), the emitted electron current density (i.e., a measure related to the number and density of electrons emitted per surface area of the filament) may improve by a factor of approximately one hundred when compared to a traditional uncoated tungsten filament at the same temperature. Accordingly, the coated filament 68 may produce significantly more electrons and a more powerful electron beam 18 when compared to the electron beam produced by a traditional filament at the same temperature. Indeed, a coating having a work function of less than approximately 4.5 eV may result in a filament 68 that produces a more powerful electron beam 18 when compared to the electron beam produced by a traditional filament at the same temperature. Additionally, the coating 74 may be selected to be resistant to certain gases that may be present in the X-ray tube assembly 58 as well as to back-bombardment of ions (e.g., rebounding electrons), resulting in a coating 74 that has a long operational life.

Further, the filament's 68 thermionic temperature (i.e., temperature at which electron emissions occur) may be regulated so that the coating 74 and not the substrate 76 may act as the primary emissive layer of the electron beam 18. A coating 74 having a lower work function will emit electrons at a lower temperature than a substrate having a higher work function. Accordingly, the temperature of the filament 68 may be set at a value, for example a value approximately 400° C. lower than the value set for a traditional filament. The coating 74 will emit electrons at the lower temperature value because of the coating's lower work function. Using lower operating temperatures may also be advantageous in prolonging the life of the coated filament 68. Filament 68 failure is traditionally driven by evaporation of the filament 68 material during thermionic operations. In high vacuum conditions, such as those found inside the X-ray tube assembly 58, material loss can be proportional to the vapor pressure of the evaporating material. Vapor pressure of the coating 74 embodiments such as coatings 74 containing hafnium carbide, tantalum carbide, hafnium diboride, zirconium carbide, hafnium nitride, tantalum nitride, zirconium nitride, and tungsten diboride, may, in some cases, be six-fold lower than that of traditional tungsten filaments at the same thermionic emission density. Accordingly, the life of the coated filament 68 may be substantially increased because the filament 68 may exhibit less material evaporation.

Another advantage of using chemicals such as hafnium carbide, tantalum carbide, hafnium diboride, zirconium carbide, hafnium nitride, tantalum nitride, zirconium nitride, tungsten diboride, and their derivatives, is that the resulting coating 74 may be very stable when disposed on the substrate 76. That is, the filament 68 may be exposed to high temperatures, for example temperatures exceeding approximately 2500° C., without the coating 74 melting or forming alloys or solutions with the underlying substrate 76. Indeed, the coating 74 may have a higher melting point than the substrate 76, including melting points of upwards of approximately 3400° C. Further, embodiments of the coating 74 may exhibit congruent evaporation, that is, the ratio of certain chemicals in the coating such as the hafnium to carbon ratio may stay constant during evaporation. Accordingly little or no variation in thermionic electron emissions may occur due to changes in chemical composition.

FIG. 3 also illustrates the coated filament 68 surrounded by four bias electrodes, namely the length inside (L-ib) bias electrode 60, the width left (W-l) bias electrode 62, the length outside (L-ob) bias electrode 64, and the width right (W-r) bias electrode 66, that may be used as an electron focusing lens. A shield 70 may be positioned to surround the bias electrodes 60, 62, 64, 66 and connected to cathode potential. The shield 70 may aid in, for example, reducing peak electric fields due to sharp features of the electrode geometry and thus improve high voltage stability. In the illustrated embodiment, the shield 70 also surrounds the coating 74. As mentioned above, the temperature of the flat filament 68 may be regulated so that a majority of the electrons are emitted from the coating 74 instead of from the substrate of the filament 68. Accordingly, the majority of the electrons may exit in a direction normal to the planar area defined by the coating 74. Thus, the resulting electron beam 18 is surrounded by the bias electrodes 60, 62, 64, and 66. The bias electrodes 60, 62, 64, and 66 may aid in focusing the electron beam 18 into a very small focal spot 72 on the anode 16 though the use of active beam manipulation. That is, the bias electrodes 60, 62, 64, and 66 may each create a dipole field so as to electrically deflect the electron beam 18. The deflection of the electron beam 18 may then be used to aid in the focal spot targeting of the electron beam 18. Width bias electrodes 62, 66 may be used to help define the width of the resulting focal spot 72, while length bias electrodes 60, 64 may be used to help define the length of the resulting focal spot 72. By combining a shaped emissive coating such as that depicted in FIG. 4 with the use of bias electrodes 60, 62, 64, and 66, a much improved focal spot performance can be achieved when compared to traditional X-ray filament embodiments. Indeed, the use of the coating 74 alone or the coating 74 in combination with bias electrodes 60, 62, 64, and 66, allows for a proper focal spot 72 to be achieved through a range of cathode-target distances of greater than 40 mm and less than 200 mm.

Figure 4:
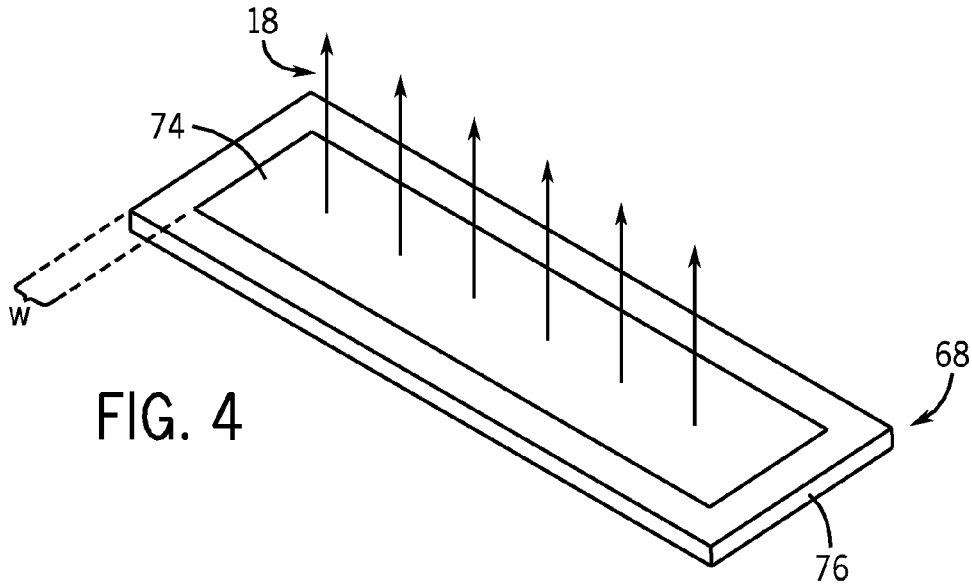
FIG. 4 depicts an embodiment of a thermionic filament having a coating disposed in a rectangular shape, in accordance with an embodiment of the present technique.

Turning to FIG. 4, the figure depicts an embodiment of a filament 68 that has been partially coated. In the illustrated embodiment, the coating 74 has been deposited or otherwise formed in a rectangular pattern and positioned in the center of the substrate 76. It is to be understood that in other embodiments, the coating 74 may completely cover the substrate 76 or may include a different shape. Indeed, any number of coating shapes or patterns may be disposed on the substrate 76. In certain embodiments, the coating 74 may be manufactured by chemical vapor deposition (CVD), by sputtering, or by other layering techniques. Other techniques such as powder pressing, high energy ball milling, and/or sintering may also be used to manufacture the coated filament 68. An additional manufacturing technique may include the use of high temperature carburization. In high temperature carburization, a coating chemical, for example hafnium, may be deposited onto the filament 68 in a certain shape or pattern. In one embodiment, the filament 68 may then be heated by an external source such as a furnace. In another embodiment, the filament 68 may then be operated at high temperature and generate its own heat. In both embodiments, the heating of the filament may result in the carburization of hafnium into hafnium carbide, thus creating a hafnium carbide coating 74. It is to be understood that other chemicals such as tantalum and zirconium may be used in conjunction with the high temperature carburization technique. Other manufacturing techniques that may be used to define a shape or a pattern of the coating 74 include microchip fabrication techniques such as photolithography, photomasking, microlitography, and so forth.

In the illustrated embodiment of FIG. 4, a rectangular coating 74 has been disposed on the substrate 76 so that portions of the edges of substrate having a width w remain uncoated. As mentioned above, the thermionic temperature of the filament 68 may be regulated so that the electron beam 18 is generated by using the coating 74 as the primary emitting surface. Accordingly, the value for the width w of the uncoated edge of the substrate 76 may be selected to optimize the electron beam focusing capabilities of the X-ray tube. The focusing capabilities of the electron beam may be optimized by selecting the value for width w such that a majority of the emitted electrons impact the anode 16 at a desired focal spot 72. Further, because the edges of the substrate 76 are left uncoated, very few electrons, if any, may be emitted from the sides of the substrate 76. Accordingly, the amount of wasted electrons is minimized because a substantial portion of the electrons are now directed at the target anode 16 instead of directed away from the target anode 16.

Figure 5:
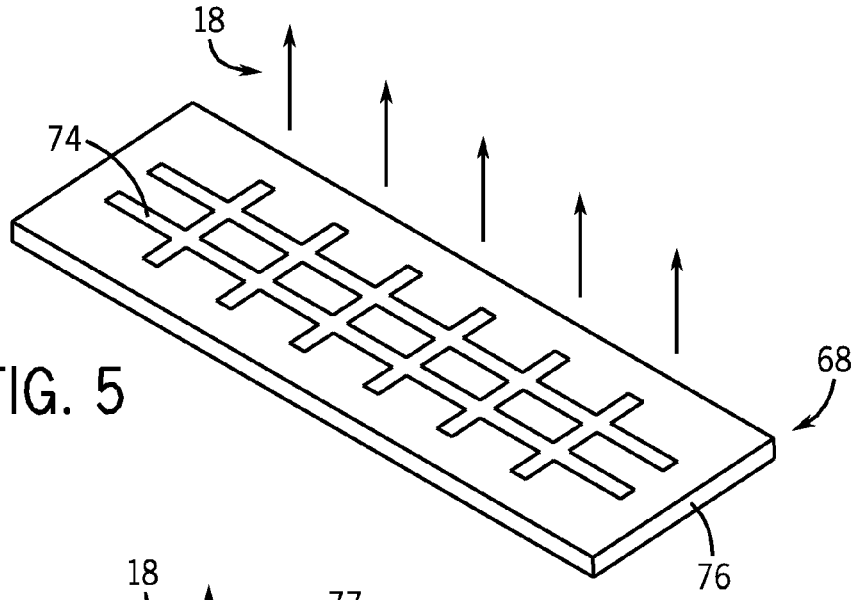
FIG. 5 depicts an embodiment of a thermionic filament having a coating disposed in a grid pattern, in accordance with an embodiment of the present technique.

Turning to FIG. 5, the figure illustrates an embodiment of the filament 68 where the coating 74 has been disposed as a grid pattern on the substrate 76. Indeed, any number of patterns, such as the illustrated grid pattern, may be used. A pattern may be selected, for example, to allow multiple focal spot 72 modalities. In one modality, the thermionic temperature may be regulated so that a majority of electrons are emitted solely by the coating 74. In another modality, the thermionic temperature may be regulated so that the electrons are emitted by both the coating 74 and the substrate 76. Accordingly, two focal spots may be created by using a single coated filament 68. The first focal spot may be created by the emissions from the coating 74 while the second focal spot may be created by the combination of emissions from the coating 74 and from the substrate 76. The ability to coat in any type of pattern thus allows for focal spot 72 flexibility by, for example, creating two focal spots 72 with a single filament 68.

In certain embodiments useful for creating a plurality of focal spots 72, the single filament 68 in combination with one or more of the bias electrode 60, 62, 64, 66, is used. In these embodiments, one or more of the bias electrodes 60, 62, 64, 66 may actively deflect the electron beam into one or more focal spots 72. For example, one or more of the bias electrodes 60, 62, 64, 66 may define a first broad focal spot 72 by minimizing the dipole field. A second, more narrow focal spot 72, may be defined by strengthening the dipole field. Indeed, any number and types of focal spots may be defined by active manipulation of the dipole field.

In yet other embodiments, a plurality of filaments 68 may be used to define multiple focal spots 72. Each of the plurality of filaments 68 may define a focal spot 72 based on characteristics of the filament, including size, shape, coating pattern, thermionic temperature, and so forth. Accordingly, several filaments 68 may be used to define different types of focal spots 72, for example focal spots 72 having different surface areas. Additionally, the embodiments utilizing multiple filaments 68 may combine the use of one or more of the bias electrodes 60, 62, 64, 66 to aid in the definition and creation of the multiple focal spots 72 as described above.

Figure 6:
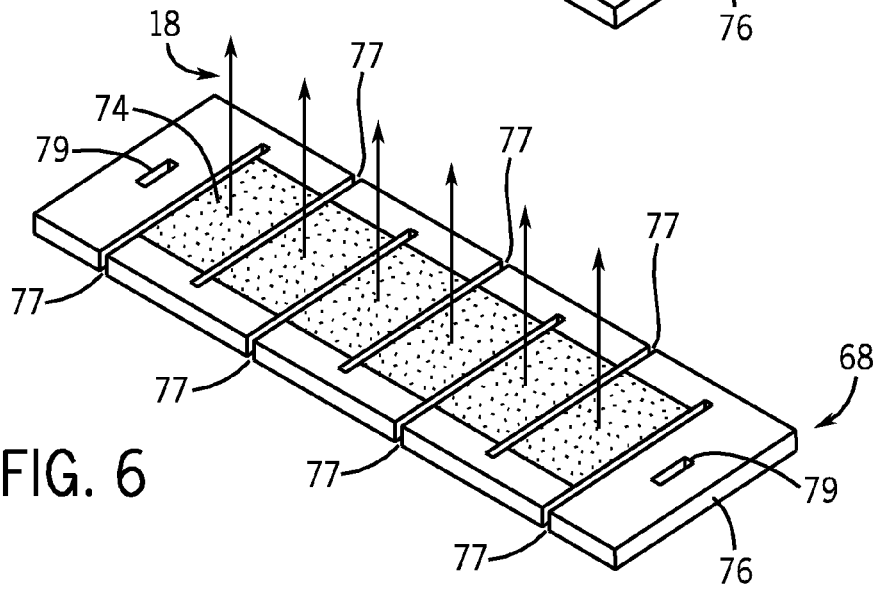
FIG. 6 depicts an embodiment of a slotted thermionic filament having a coating disposed in a rectangular shape, in accordance with an embodiment of the present technique.

FIG. 6 illustrates an embodiment of the filament 68 where the filament 68 is a slotted, flat filament 68. A plurality of slots 77 are disposed on the substrate 76 of the filament 68, resulting in a filament 68 having a roughly zigzag shape. The slots 77 reduce the cross section of the filament 68. Accordingly, a heating current capable of heating the filament 68 may be much reduced (e.g. to values approximately less than 20 A) because the heating current flows through the reduced cross section. Such a reduction in the heating current may result in increased efficiency and lifespan of the filament 68. Two openings 79 are included in the substrate 76 so as to aid in affixing the substrate 76 to the cathode assembly 14.

In the illustrated embodiment of FIG. 6, the coating 74 has been disposed in plurality of rectangular shapes on the substrate 76. As mentioned previously, the coating 74 may be used to emit electrons by regulating the thermionic temperature of the filament 68 so that a majority of electrons are emitted solely by the coating 74. It is to be understood that the coating 74 and the coating patterns described above may be disposed on other filament embodiments, such as wound filament embodiments described in more detail with respect to FIG. 7 below.

FIG. 7 depicts an embodiment of a wound filament 78 that includes the coating 74 placed on the target-facing surface of the wire substrate 80. A traditional wound filament typically emits electrons throughout the entirety of the wound filament's surface. Accordingly, a significant amount of energy is used to emit electrons from portions of the wire of the traditional filament that are not targeted towards the anode 16. Indeed, a majority of the surfaces of the traditional wound filament, such as the top surfaces of the lower windings of the wound filament 78, are usually oriented away from the target anode 16. By way of contrast, the disclosed embodiments allow for the coating 74 to be placed on the wire substrate 80 so that the coating 74 is always facing the anode 16.

As mentioned previously, the wound filament's 78 temperature may be regulated so that the coating 74 acts as the primary emissive layer. Accordingly, by placing the coating 74 to face the anode 16, a substantial portion of the emitted electrons 18 may impact a very small focal spot on the anode 16. The coated wound filament 78 is thus able to provide for better focal spot performance and increased cathode-target distance when compared to a traditional wound filament. Further, the coated wound filament 78 may realize a longer lifespan when compared to traditional wire wound filaments. The evaporative properties of the coating 74 allow for less material evaporation, thus increasing the operating life of the filament 78. Indeed, all filament embodiments disclosed herein, including wound filament 78, may realize longer life spans.

Turning to FIG. 8, the figure illustrates an embodiment of a straight wire filament 82 being positioned in a reflector cup 84. In the illustrated embodiment, the wire substrate 80 is not wound but is a straight wire. The coating 74 may be placed on the anode-facing surface of the wire substrate 80, and the wire substrate 80 may then be placed inside the reflector cup 84. The reflector cup 84 aids in focusing the electron beam 18 by passively shaping the electron beam 18. The passive shaping of the electron beam 18 may be achieved through a geometric shape of the cup 84, a location of the wire filament 82 in the cup, and/or a placement of the coating 74 on the wire substrate 80. For example, the curved portions 85 of the cup 84 may be curved outwardly in order to define a broader beam 18, or inwardly in order to define a narrower beam 18. The wire filament 82 may be placed at a higher height in the cup 84 in order to define a broader beam 18, or at a lower height in the cup 84 in order to define a narrower beam 18. The coating 74 may placed on a greater portion of the surface of the wire filament 82 in order to define a broader beam 18, or may be placed on a lesser portion of the surface of the wire filament 82 in order to define a narrower beam. Indeed, any number of cup 84 shapes, wire filament 82 locations, and/or coating placements may be used so as to arrive at a variety of focal spots 72 through the use of passive electron beam 18 shaping. It is to be understood that any number of coated filaments embodiments, such as the flat filament 68 described in FIGS. 2, 3, 4, 5 and 6, may be used with a reflector cup such as cup 84. Indeed, the disclosed coated filament embodiments may be used with the reflector cup 84 and/or with the bias electrodes 60, 62, 64, and 66 shown in FIGS. 2 and 3.

Turning to FIG. 9, the figure illustrates an embodiment of a curved disk filament emitter 86 having a coating 74 that may be used for indirect heating emissions. Electrons may be emitted from a material regardless of how the material is heated. The material may be heated directly or indirectly, for example, by bombarding the material itself with electrons. That is, electron emission may itself be used to cause heating, resulting in a thermionic effect and additional electron emission. As illustrated, an electron source 88, such as a directly heated tungsten wire, may emit an electron beam 90 and direct the electron beam 90 to focus on the rear of the curved disk filament 86. The electron beam 90 may impinge upon the curved disk filament 86 and cause the temperature of the curved disk filament 86 to rise. The heat in the curved disk filament 86 may then be transferred to the coating 74, through, for example, heat conduction. Accordingly, the coating 74 may be heated to the point where the coating 74 emits electrons through the thermionic effect. Indeed, in certain embodiments where a wire is acting as the electron source 88, the coating 74 may produce more electrons than the number of electrons being generated by the wire.

The curved substrate 87 of the curved disk emitter 86 may be shaped so as to optimally generate an electron beam 18 into a very small focal spot 72. Accordingly, a curvature (i.e., slope) of the curved substrate 87 may be calculated based on the desired size and distance from the focal spot 72. Increasing the slope of the curved substrate 87 will focus the electron beam 18 into a smaller, closer focal spot 72. Decreasing the slope of the curved substrate 87 will focus the electron beam 18 into a larger, more distant focal spot 72. Similarly, the coating 74 may also aid in focusing the electron beam 18. For example, coating a larger area of the substrate 87 will result in a more powerful electron beam 18 that may impinge on a slightly larger focal spot 72. Additionally, the curved emitter 86 may be placed in a reflector cup 84 and/or used with the bias electrodes 60, 62, 64, and 66 shown in FIGS. 2 and 3 so as to improve focal spot performance.

It is to be understood that the disclosed X-ray tube cathodes and resulting X-ray tube assemblies may be retrofitted to existing imaging systems. That is, an X-ray tube containing the disclosed cathode embodiments may replace a traditional X-ray tube. No other modification of the retrofitted imaging system may be necessary other than the replacement of the X-ray tube. In retrofits where other optimization may be desired, for example, lower operating temperatures, the drive of the retrofitted imaging system may be modified.

Technical effects of the invention include the capability to increase the cathode-target distance, the ability to decrease the focal spot size, a substantial increase in the production of X-ray radiation using traditional energy levels, and filament of longer duration. Increasing the cathode-target distance allows for the placement of other devices, such as electron collectors or beam handling magnets, inside of X-ray tube assemblies. The disclosed embodiments allow for additional focusing systems, modalities, and techniques that greatly improve the electron beam quality and power.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray tube cathode assembly system comprising:
- a substrate comprising a flat slab, wherein the entirety of the substrate is disposed on the same geometric plane when in use; and,
- a coating disposed on a limited portion of the substrate such that a remainder portion of the substrate is uncoated by the coating;
- wherein an electron beam is emitted from the coating and not from the substrate through a thermonic effect at a first temperature, wherein the electron beam is emitted from the coating and from the substrate a second temperature higher than the first temperature.

2. The system of claim 1, wherein the coating comprises at least one of hafnium carbide, tantalum carbide, hafnium diboride, zirconium carbide, hafnium nitride, tantalum nitride, zirconium nitride, or tungsten diboride.

3. The system of claim 1, wherein the substrate comprises at least one of tungsten, tantalum, doped tungsten, or doped tantalum.

4. The system of claim 1, wherein the substrate is disposed at a target-facing distance from a target anode of at least 50mm.

5. The system of claim 1, wherein the coating comprises a work function lower than approximately 4.5 electron volts (eV).

6. The system of claim 1, wherein the thermionic effect is realized through direct heating, indirect heating, or a combination thereof.

7. The system of claim 1, wherein the coating is disposed on the substrate through the use of chemical vapor deposition, sputtering, powder pressing, high energy ball milling, sintering, high temperature carburization, or a combination thereof.

8. An X-ray tube system comprising:
- a cathode filament comprising a coating disposed on a limited portion of a substrate comprising a flat slab, wherein the entirety of the substrate is disposed on the same geometric plane when in use, and wherein a remainder portion of the substrate is uncoated by the coating; and,
- a target anode positioned a cathode-target distance away from and facing the cathode filament, wherein a first stream of electrons is emitted from the cathode filament coating and not from the substrate through a thermionic effect at a first temperature and accelerated into a first focal spot on the target anode to produce X-rays, wherein the limited portion of the substrate that is coated faces the target anode, and wherein a second stream of electrons is emitted from the uncoated portion of the substrate at a second temperature higher than the first temperature, and wherein the first and the second streams of electrons are accelerated into a second focal spot to produce X-rays.

9. The system of claim 8, wherein the coating comprises at least one of hafnium carbide, tantalum carbide, hafnium diboride, zirconium carbide, hafnium nitride, tantalum nitride, zirconium nitride, or tungsten diboride and the substrate comprises at least one of tungsten, tantalum, doped tungsten, or doped tantalum.

10. The system of claim 8, wherein the cathode-target distance comprises a distance of greater than approximately 40mm.

11. The system of claim 8, comprising at least one bias electrode, reflector cup, or combination thereof, wherein the bias electrode actively deflects the first stream of electrons and the reflector cup passively shapes the first stream of electrons.

12. The system of claim 8, comprising at least one bias electrode and a second focal spot on the target anode, wherein the bias electrode actively deflects the first stream of electrons into either of the first focal spot or the second focal spot to produce X-rays.

13. The system of claim 8, comprising an extraction electrode positioned a cathode-electrode distance away from the cathode filament, wherein the extraction electrode aids in accelerating the first stream of electrons into a first focal spot on the target anode.

14. The system of claim 13, wherein the cathode-electrode distance comprises a distance of greater than approximately 15mm.

15. A method for manufacturing an X-ray tube cathode system comprising:
- manufacturing a filament substrate comprising a flat slab so that the entirety of the filament substrate is disposed on the same geometric plane when in use;
- disposing a coating on a limited portion of the filament substrate such that a remainder portion of the filament substrate remains uncoated; and
- placing the filament substrate in a cathode assembly;
- wherein the coating has a lower work function than the filament substrate and wherein, in operation, a first stream of electrons is emitted from the coating at a first temperature and second stream of electrons is emitted and from the filament substrate at a second temperature greater than the first temperature.

16. The method of claim 15, wherein the coating comprises at least one of hafnium carbide, tantalum carbide, hafnium diboride, zirconium carbide, hafnium nitride, tantalum nitride, zirconium nitride, or tungsten diboride and the substrate comprises at least one of tungsten, tantalum, doped tungsten, or doped tantalum.

17. The method of claim 15, wherein the coating is disposed on the substrate through the use of chemical vapor deposition, sputtering, powder pressing, high energy ball milling, sintering, high temperature carburization, or a combination thereof.

* * * * *